US006428261B1

(12) United States Patent
Zysset

(10) Patent No.: US 6,428,261 B1
(45) Date of Patent: Aug. 6, 2002

(54) METHOD OF FORMING A SAFETY CAN END

(75) Inventor: Edgar H. Zysset, St. Clour, FL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/578,044

(22) Filed: May 24, 2000

(51) Int. Cl.[7] ..... B21D 51/44

(52) U.S. Cl. ..... 413/8; 413/13; 413/17; 413/14

(58) Field of Search ..... 413/8, 13, 14, 413/15, 16, 56, 17; 220/269, 270, 276

(56) References Cited

U.S. PATENT DOCUMENTS

| | | | | |
|---|---|---|---|---|
| 3,765,352 A | * | 10/1973 | Schubert et al. | 413/17 |
| 3,939,787 A | | 2/1976 | Morrison et al. | 113/121 C |
| 3,949,692 A | | 4/1976 | DeLine et al. | 113/121 C |
| 3,986,632 A | | 10/1976 | Morrison et al. | 220/273 |
| 3,990,376 A | | 11/1976 | Schubert et al. | 113/121 C |
| 4,018,178 A | | 4/1977 | Klein et al. | 113/121 C |
| 4,052,949 A | * | 10/1977 | Woodley | 413/14 |
| 4,129,085 A | * | 12/1978 | Klein | 413/14 |
| 4,386,713 A | * | 6/1983 | Baumeyer et al. | 413/14 |
| 4,394,927 A | | 7/1983 | Zysset | 220/273 |
| 4,406,378 A | | 9/1983 | Zysset | 220/273 |
| 4,455,114 A | | 6/1984 | Zysset | 413/14 |
| 4,540,105 A | | 9/1985 | Wright | 220/359 |
| 4,848,623 A | * | 7/1989 | Saunders et al. | 413/17 |
| 5,038,956 A | * | 8/1991 | Saunders | 220/270 |
| 5,069,356 A | * | 12/1991 | Zysset | 413/16 |
| 5,252,019 A | * | 10/1993 | Saunders et al. | 413/17 |
| 5,823,730 A | | 10/1998 | La Rovere | 413/12 |
| 5,927,536 A | * | 7/1999 | Oyagi et al. | 413/17 |

* cited by examiner

*Primary Examiner*—Stephen F. Gerrity
*Assistant Examiner*—Louis Huynh
(74) *Attorney, Agent, or Firm*—Knoble & Yoshida, LLC

(57) ABSTRACT

A method of making a safety easy-open end for a container includes forming a safety fold that includes an intermediate panel that overlies an end panel of a can end blank and is connected to the end panel by a first bead, a top panel that overlies the intermediate panel and that is connected to the intermediate panel by a second, safety bead, and a transition region connecting the top panel to the double-seam area of the end. Advantageously, the top panel and the intermediate panel are both angled radially outwardly and upwardly with respect to the end panel, which increases the resistance of the safety easy-open end against pressure-induced failure.

17 Claims, 4 Drawing Sheets

METHOD OF FORMING A SAFETY CAN END

BACKGROUND OF THE INVENTION

1. Field of the Invention

This invention relates to easy-open metallic containers, which are defined as being openable by a consumer without a can opener or other tool, and methods for making such containers. More specifically, this invention relates to an improved method for making a full open type easy-open closure that provides consumers protection against finger cuts while at the same time being resistant to pressure-induced failure.

2. Description of the Related Technology

An easy open end, for the purposes of this document, may be defined as a can end that is designed to be opened by a consumer without using a can opener or similar tool. A full-open type can end is, as opposed to a pour-type easy-open can end, designed to be completely removable from the can end during opening to provide unimpeded access to the inside of the can. Full-open type can ends are commonly utilized for packaging loose solids, such as mixed nuts or coffee, while pour-type can ends tend to be utilized for soft drinks or other beverages. Full-open type easy-open can ends are also used for packaging products of a non-food nature, such as tennis balls, which must be kept in a pressurized environment after manufacture to avoid deformation, particularly in the seam area.

When an end panel of an easy-open type closure separates as designed at a score line during opening, the resulting edges tend to be sharp, posing a possible danger to the consumer. One solution to this problem was presented in U.S. Pat. 3,705,363 to Elser. FIGS. 1 and 2 depict a can end and method of making as it is described in the Elser patent. As may be seen in FIG. 1, the Elser patent describes a container 10 having a full open closure 12 that includes a panel 13 and a circumferential score 14. A gripping tab 16 is riveted to the end panel 13 for the purpose of rupturing the score 14 when the gripping tab 16 is lifted by a consumer. Referring to FIG. 2, the closure 12 further includes a safety fold 17 that is formed by the interaction of die members 18, 20, 22 and 24. As may be seen in FIG. 2, safety fold 17 includes a lower bead 28 that is radiused so as to be unitary with the end panel 13 at one end and further unitary at a second end with an intermediate panel 30 that overlies panel 13 at a second, opposite end. Safety fold 17 further includes an upper bead 26 that is radiused so as to be unitary with the intermediate panel 30 at one end thereof and similarly with an upper panel 32 at a second end thereof that overlies the intermediate panel 30. A transition portion 34 is unitary with the upper panel 30 at one end and transitions the upper panel 32 into the blank 36 that is used to form the double seam connecting the closure 12 to the sidewall of the container 10.

As can be visualized by viewing FIG. 2, the upper bead 26, because it protrudes slightly inwardly of the leftward edge of score 14, will be positioned to contact a consumer's finger before the consumer's finger contacts with the potentially sharp edge that is formed during separation of the end panel 13 at the score line 14 during opening. As a result, some protection is afforded by this design to the consumer against finger cuts.

In the embodiment of the Elser patent that is depicted in FIG. 2, the intermediate panel 30 and the upper panel 32 are positioned so as to be roughly parallel to reach other, and also roughly parallel to the underlying end panel 13. In practice, however, it has been common to manufacture such closures as is instead shown in FIG. 3. In this configuration, the intermediate panel 30' is inclined with respect to the end panel 13 so as to form an angle A1 opening radially inwardly. This angle A1 and a second angle A2 that is defined between the upper panel 32' and the end panel 13 and that also opens radially inwardly toward the center of the end panel 13, are both designed to be about five or six degrees.

Unfortunately, the configurations that are shown in FIGS. 2 and 3 have been found to be susceptible to pressure induced failure, which occurs when the container 10 is given a positive pressure, such as is required in the packaging of tennis balls. The present inventor has studied the mechanism by which this occurs, and has determined that the interior pressure causes the end panel 13 of the closure 12 to bow upwardly, with the greatest deformation occurring in the centermost part of the panel 13. As this occurs, the outward portions of the end panel 13 are pulled radially inwardly, or to the right as it is viewed in FIG. 3. This causes the lower bead 28 to begin to open, meaning that the angle A1 begins to increase, which reduces the overall strength of the safety fold 38. This culminates in a failure of the closure 12 that is symptomized by an outward folding of the closure 12 over the safety fold 38, the fold line tending to be oriented generally radially.

A need exists for an improved process for manufacturing a safety easy opening end that is more resistant to pressure induced failure than conventional closures of this type, such as those that are discussed above with reference to FIGS. 1–3.

SUMMARY OF THE INVENTION

Accordingly, it is an object of the invention to provide an improved process for manufacturing a safety easy opening end that is more resistant to pressure induced failure than conventional closures of this type.

In order to achieve the above and other objects of the invention, a method of making a safety easy-open end for a container includes, according to a first aspect of the invention, steps of providing an end blank having an end panel that extends substantially within a first plane and a circumferential outer double-seaming portion; scoring the end panel to define a removable area; forming the end blank to define a safety fold including an intermediate panel that is unitary with and overlies the end panel and that is connected to the end panel by a first bead, a top panel that extends substantially within a second plane and is unitary with and overlies the intermediate panel and that is connected to the intermediate panel by a second, safety bead, and a transition region that is unitary with and connects the top panel to the double-seaming portion; and wherein step (c) is performed so that said first and second planes intersect at said end panel at a location that is radially inward from said first bead; and securing an opening tab to the end panel. According to a second aspect of the invention, a method of making a safety easy-open end for a container includes steps of providing an end blank having an end panel that extends substantially within a first plane and a circumferential outer double-seaming portion; scoring the end panel to define a removable area; forming the end blank to define a safety fold including an intermediate panel that extends substantially within a third plane and is unitary with and overlies the end panel and that is connected to the end panel by a first bead, a top panel that extends substantially within a second plane and is unitary with and overlies the intermediate panel and that is connected to the intermediate panel by a second, safety bead, and a transition region that is unitary with and connects the top panel to the double-seaming portion; and wherein step (c) is performed so that said first and third planes intersect at said end panel at a location that is radially inward from said first bead; and securing an opening tab to the end panel.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
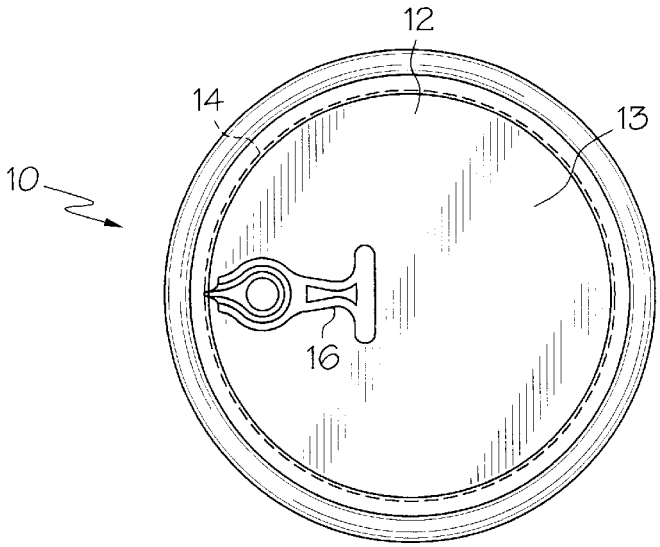
FIG. 1 PRIOR ART
FIG. 1 is a top plan view of a prior art full open type easy-open closure.
Figure 2:
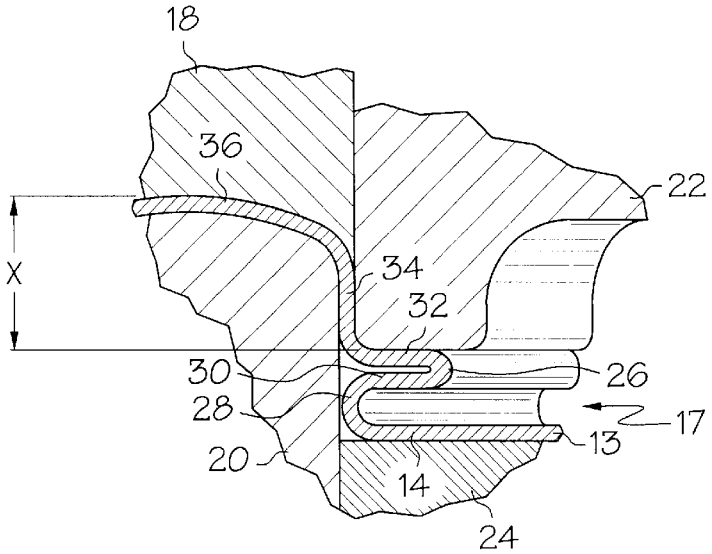
FIG. 2 PRIOR ART
FIG. 2 is a fragmentary cross-sectional view depicting formation of the closure shown in FIG. 1.
Figure 3:
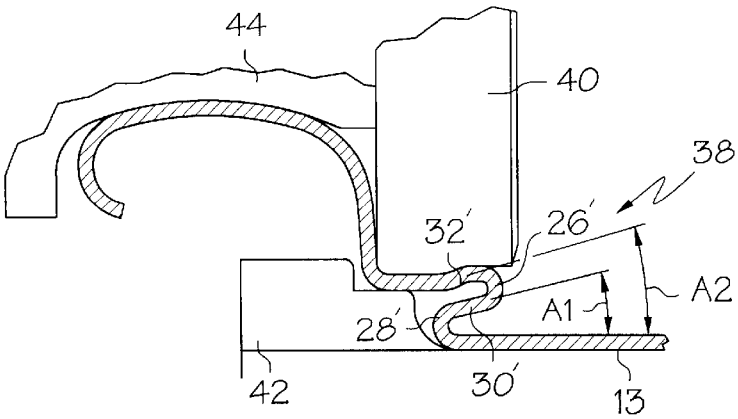
FIG. 3 PRIOR ART
FIG. 3 is a fragmentary cross-sectional view depicting formation of a closure according to a slightly different prior art process.
Figure 4A:
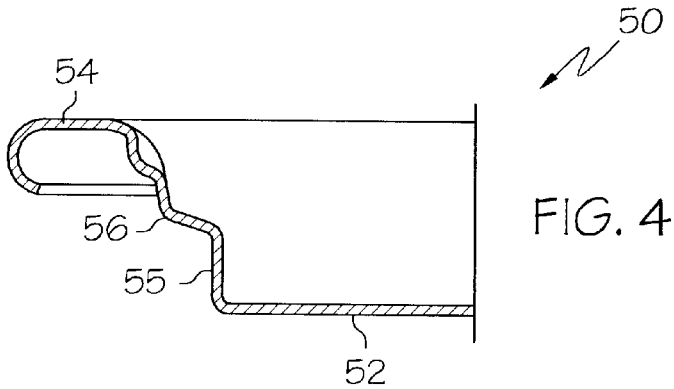
FIGS. 4(*a*) through 4(*d*) depict a method of making an improved safety full open easy-open closure according to a preferred embodiment of the invention.
Figure 4B:
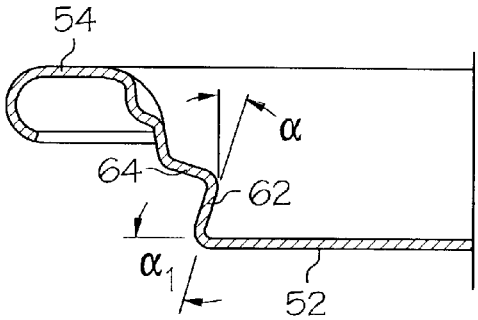
Figure 4C:
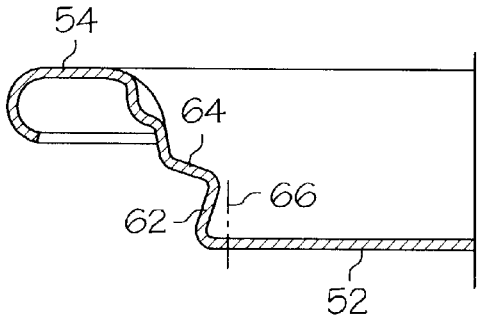
Figure 4D:
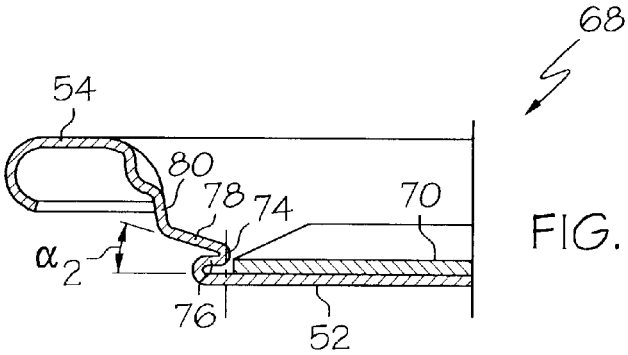

Referring now to the drawings, wherein like reference numerals designate corresponding structure throughout the views, and referring in particular to FIGS. 4(*a*), 4(*b*), 4(*c*) and 4(*d*), a method of making a safety type easy opening end for a container according to a preferred embodiment of the invention involves providing a can end blank 50 having an end panel 52 that extends substantially within a first plane and includes a circumferential outer double seam portion 54 that is configured and sized conventionally to be joined to a container body by the double-seaming process.

Figure 5A:
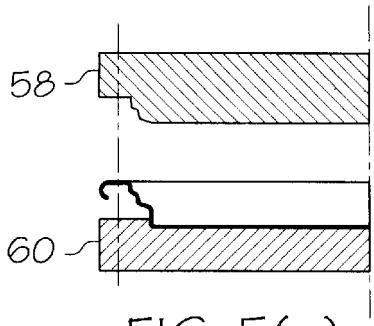
FIGS. 5(*a*) and 5(*b*) are a more detailed view of the formation step shown in FIG. 4(*b*), with the tooling being shown.
Figure 5B:
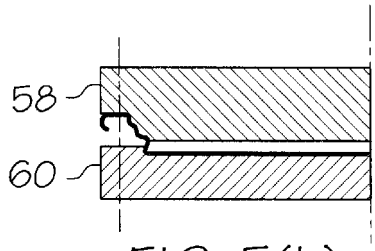

As may be seen in FIG. 4(*a*), the end blank 50 includes a vertical sidewall 55 that is unitary with the end panel 52 at one end and is joined to the outer portion 54 at a second end by means of a transition portion 56. Referring briefly to FIGS. 5(*a*) and 5(*b*) and also to FIG. 4(*b*), the end blank 50 is positioned between a first die 58 and a second die 60, as is shown in FIG. 5(*a*), and is compressed between the first and second dies 58, 60, as is shown in FIG. 5(*b*). Looking now to FIG. 4(*b*), it will be seen that this has the effect of bending the vertical sidewall 55 inwardly into a conical side wall 62 that is, in cross-section, angled with respect to the end panel 52 at an angle $\alpha_1$ that is preferably within a range of about 3 degrees to about 15 degrees, more preferably within a range of about 5 degrees to about 10 degrees, and most preferably about 8 degrees. The forming step depicted in FIG. 4(*b*) also changes the shape of the transition area 56 to that of the transition area 64 that is shown in FIG. 4(*b*).

Figure 6A:
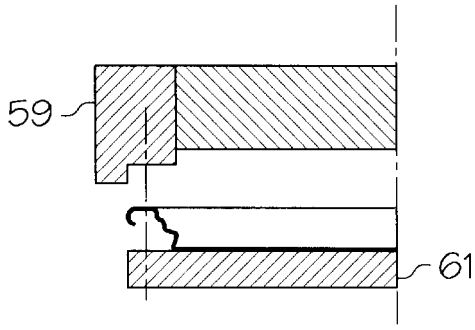
FIGS. 6(*a*) and 6(*b*) are a more detailed view of the formation step shown in FIG. 4(*c*), with the tooling being shown.
Figure 6B:
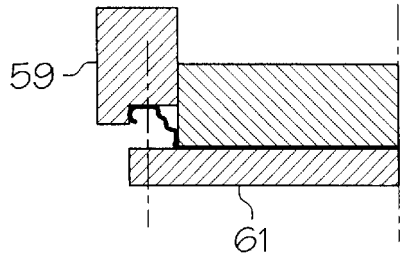

The can end blank is next preferably transferred to a second scoring, which is depicted in cross section in FIGS. 6(*a*) and 6(*b*). As may be seen in FIG. 6(*a*), the end blank is positioned between a first die 59 and a second die 61, which has the effect of scoring the end panel 52 to include a score 66, as is shown in FIG. 4(*c*).

Figure 7A:
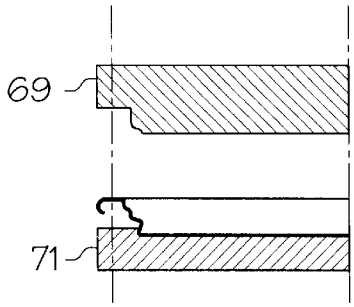
FIGS. 7(*a*) and 7(*b*) are a more detailed view of the formation step shown in FIG. 4(*c*), with the tooling being shown.
Figure 7B:
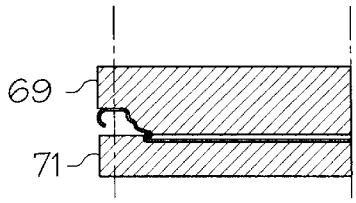

The can end blank is then transferred to a final fold station that includes an upper die 69 and a lower die 71, as is shown in FIGS. 7(*a*) and 7(*b*). As is best shown in FIG. 4(*b*), this has the effect of folding the conical sidewall 62 and the transition area 64 so as to define a can end 68 that includes an intermediate panel 76 that is unitary with and overlies the end panel 52 and that is connected to the end panel 52 by a first, lower bead 72. Also defined in the step is a top panel 78 that extends substantially within a second plane and is unitary with and overlies the intermediate panel 76. The top panel, as is clearly shown in FIG. 4(*d*), overlies the intermediate panel 76 and is connected to the intermediate panel 76 by a second, upper, safety bead 74. Also defined in the step that is performed at the final fold station is the formation of a transition region 80 that is unitary with and connects the top panel 78 to the double seam portion 54 of the can end 68.

Figure 8:
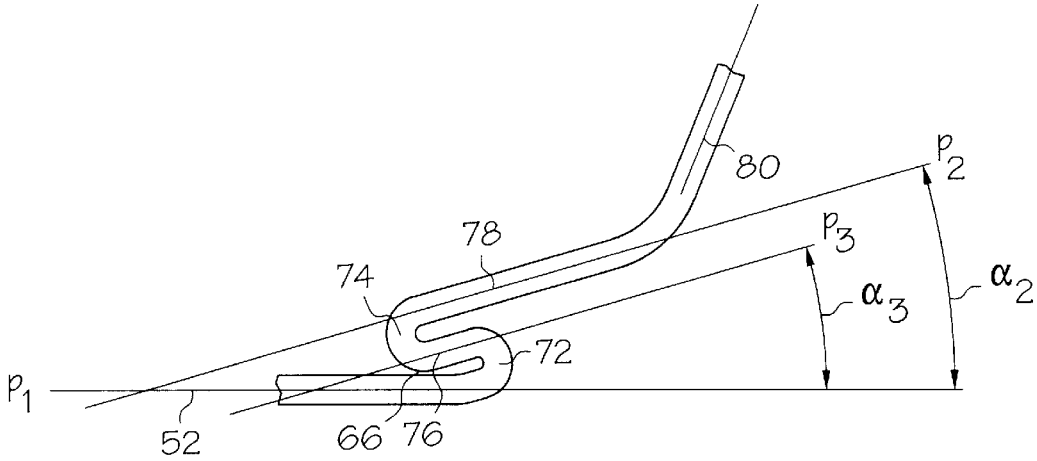
FIG. 8 is a fragmentary cross-sectional view showing a detailed view of a portion of the can end that is depicted in FIG. 4(*d*).

According to one important aspect of the invention, the first plane in which the end panel 52 resides is angled with respect to the second plane in which the top panel 78 resides so that the first and second planes will project to a point of intersection that is on the end panel 52 at a location that is radially inward from the first bead 72. In other words, the top panel 78 is inclined upwardly and outwardly with respect to the end panel 52 so that an angle $\alpha_2$, perhaps best visible in FIG. 8, is defined that opens upwardly and radially outwardly with respect to the center of can end 68. Preferably, the angle $\alpha_2$ defined by the first and second planes is within the range of about 10 degrees to about 30 degrees. More preferably, this angle $\alpha_2$ is within the range of about 15 degrees to about 25 degrees. Most preferably, the angle $\alpha_2$ is about 20 degrees.

As may further be seen in FIG. 4(*d*) and FIG. 8, the intermediate panel 76 extends substantially within a third plane, and the intermediate panel 76 is preferably inclined with respect to the end panel 52 so that the first and third planes also intersect at a line of intersection that is on the end panel 52 and that is likewise at a location that is radially inward from the first bead 72. Preferably, the first and third planes form an angle $\alpha_3$ that is within the range of about 10 degrees to about 30 degrees. More preferably, this angle $\alpha_3$ is within the range of about 15 degrees to about 25 degrees. Most preferably, the angle $\alpha_3$ is about 20 degrees, and the third plane is preferably substantially parallel to the second plane in which the top panel 78 resides.

As a final step in the forming process, a tab 70 is secured to the can end 68 in a conventional process.

It has been found that the configuration described herein provides superior resistance against pressure induced deformation and failure in a full open easy open container end, such as those that are in demand for the packaging of tennis balls.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of making a safety easy-open end for a container, comprising steps of:

(a) providing an end blank having an end panel that extends substantially within a first plane and a circumferential outer double-seaming portion;

(b) scoring the end panel to define a removable area;

(c) in no particular order with respect to step (b), forming the end blank to define a safety fold including:

an intermediate panel that is unitary with and overlies the end panel and that is connected to the end panel by a first bead, a top panel that extends substantially within a second plane so as to extend upwardly and radially outwardly away from said end panel and is unitary with and overlies the intermediate panel and that is connected to the intermediate panel by a second, safety bead, and a transition region that is unitary with and connects the top panel to the double-seaming portion; and wherein step (c) is performed so that said first and second planes intersect at said end panel at a location that is radially inward from said first bead so as to form an angle that is within a range of about 10 degrees to about 30 degrees; and (d) securing an opening tab to said end panel.

2. A method according to claim 1, wherein said first and second planes form an angle that is within the range of about 15 degrees to about 25 degrees.

3. A method according to claim 2, wherein said first and second planes form an angle that is about 20 degrees.

4. A method according to claim 1, wherein said intermediate panel extends substantially within a third plane, and wherein step (c) is further performed so that said second and third planes are substantially parallel.

5. A method according to claim 1, wherein step (c) is performed with a non-venting tool.

6. A method of making a safety easy-open end for a container, comprising steps of:

(a) providing an end blank having an end panel that extends substantially within a first plane and a circumferential outer double-seaming portion;

(b) scoring the end panel to define a removable area;

(c) in no particular order with respect to step (b), forming the end blank to define a safety fold including:

an intermediate panel that is unitary with and overlies the end panel and that is connected to the end panel by a first bead, a top panel that extends substantially within a second plane so as to extend upwardly and radially outwardly away from said end panel and is unitary with and overlies the intermediate panel and that is connected to the intermediate panel by a second, safety bead, said intermediate panel extending substantially within a third plane, and a transition region that is unitary with and connects the top panel to the double-seaming portion; and wherein step (c) is further performed so that said first and third planes intersect at said end panel at a location that is radially inward from said first bead; and (d) securing an opening tab to said end panel.

7. A method according to claim 6, wherein said first and third planes form an angle that is within the range of about 10 degrees to about 30 degrees.

8. A method according to claim 7, wherein said first and third planes form an angle that is within the range of about 15 degrees to about 25 degrees.

9. A method according to claim 8, wherein said first and third planes form an angle that is about 20 degrees.

10. A method of making a safety easy-open end for a container, comprising steps of:

(a) providing an end blank having an end panel that extends substantially within a first plane and a circumferential outer double-seaming portion;

(b) scoring the end panel to define a removable area;

(c) in no particular order with respect to step (b), forming the end blank to define a safety fold including:

a top panel that extends substantially within a second plane, an intermediate panel that extends substantially within a third plane and is unitary with and overlies the end panel and that is connected to the end panel by a first bead so as to extend upwardly and radially outwardly away from said end panel, wherein said top panel is unitary with and overlies the intermediate panel and that is connected to the intermediate panel by a second, safety bead, and a transition region that is unitary with and connects the top panel to the double-seaming portion; and wherein step (c) is performed so that said first and third planes intersect at said end panel at a location that is radially inward from said first bead and further form an angle that is within the range of about 10 degrees to about 30 degrees; and (d) securing an opening tab to said end panel.

11. A method according to claim 10 wherein said first and second planes form an angle that is within the range of about 10 degrees to about 30 degrees.

12. A method according to claim 11, wherein said first and second planes form an angle that is within the range of about 15 degrees to about 25 degrees.

13. A method according to claim 12, wherein said first and second planes form an angle that is about 20 degrees.

14. A method according to claim 10, wherein step (c) is further performed so that said second and third planes are substantially parallel.

15. A method according to claim 10, wherein said first and third planes form an angle that is about 20 degrees.

16. A method according to claim 10, wherein step (c) is performed with a non-venting tool.

17. A method of making a safety easy-open end for a container, comprising steps of:

(a) providing an end blank having an end panel that extends substantially within a first plane and a circumferential outer double-seaming portion;

(b) scoring the end panel to define a removable area;

(c) in no particular order with respect to step (b), forming the end blank to define a safety fold including:

a top panel that extends substantially within a second plane, an intermediate panel that extends substantially within a third plane and is unitary with and overlies the end panel and that is connected to the end panel by a first bead so as to extend upwardly and radially outwardly away from said end panel, wherein said top panel is unitary with and overlies the intermediate panel and that is connected to the intermediate panel by a second, safety bead, and a transition region that is unitary with and connects the top panel to the double-seaming portion; and wherein step (c) is performed so that said first and third planes intersect at said end panel at a location that is radially inward from said first bead and said first and third planes form an angle that is within the range of about 15 degrees to about 25 degrees; and (d) securing an opening tab to said end panel.

* * * * *